US006499176B1

(12) United States Patent
Hammond

(10) Patent No.: US 6,499,176 B1
(45) Date of Patent: Dec. 31, 2002

(54) BROOM DEVICE

(76) Inventor: Vern A. Hammond, 2664 W. Church St., Eden, NY (US) 14057

( * ) Notice: Subject to any disclaimer, the term of this patent is extended or adjusted under 35 U.S.C. 154(b) by 50 days.

(21) Appl. No.: 09/838,834

(22) Filed: Apr. 20, 2001

(51) Int. Cl.[7] ..... A46B 5/02
(52) U.S. Cl. ..... 15/176.2; 15/145
(58) Field of Search ..... 15/145, 159.1, 15/171, 173, 176.1, 176.2, 176.6

(56) References Cited

U.S. PATENT DOCUMENTS

| | | | | |
|---|---|---|---|---|
| 334,214 | A | * | 1/1886 | Barringer |
| 2,152,358 | A | * | 3/1939 | Palmeri |
| 3,183,540 | A | * | 5/1965 | McCrink |
| 3,524,210 | A | * | 8/1970 | McLean |
| 3,682,516 | A | | 8/1972 | Savage |
| 3,707,739 | A | * | 1/1973 | Hermann |
| 3,891,339 | A | | 6/1975 | Jeffers |
| 4,293,972 | A | * | 10/1981 | Pomares |
| 4,928,342 | A | * | 5/1990 | Freidman et al. |
| 5,172,447 | A | | 12/1992 | Tomm |
| 5,210,898 | A | * | 5/1993 | Carey |
| D379,422 | S | | 5/1997 | Yates et al. |
| 5,758,385 | A | | 6/1998 | Waldner |

* cited by examiner

*Primary Examiner*—Terrence R. Till

(57) ABSTRACT

A broom device for removably securing a handle to a broom an improved manner. The broom device includes a bar having a top side, a bottom side and peripheral edge. The bar is elongate and has a first end and a second end. A hole extends through the top and bottom sides of the bar and is positioned generally between the first and second ends. A panel has an upper surface, a lower surface and a peripheral edge extending between the upper and lower surfaces. The panel has at least one aperture therein extending through the upper and lower surfaces. Each of a plurality of bristles is attached to and extends away from the lower surface of the panel. The bristles are resiliently flexible. A pole is elongate and has a first end and a second end. A rod is attached to and extends away from the first end of the pole. The top side of the bar is abutted against the bottom surface of the panel such that the aperture is aligned with the hole. The cap is extended into the aperture such that rod is extended through the aperture. A securing member is removably secured to the rod.

11 Claims, 3 Drawing Sheets

60
58
50
68
56
54
64
62
66
20
14
22
18
12
16
70

BROOM DEVICE

BACKGROUND OF THE INVENTION

1. Field of the Invention

The present invention relates to broom devices and more particularly pertains to a new broom device for removably securing a handle to a broom an improved manner.

2. Description of the Prior Art

The use of broom devices is known in the prior art. More specifically, broom devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,293,972; 5,758,385; 3,682,516; 5,172,447; 3,891,339; and U.S. Des. Pat. No. 379,422.

While these devices fulfill their respective, particular objectives and requirements, the aforementioned patents do not disclose a new broom device. The inventive device includes a bar having a top side, a bottom side and peripheral edge. The bar is elongate and has a first end and a second end. A hole extends through the top and bottom sides of the bar and is positioned generally between the first and second ends. A panel has an upper surface, a lower surface and a peripheral edge extending between the upper and lower surfaces. The panel has at least one aperture therein extending through the upper and lower surfaces. Each of a plurality of bristles is attached to and extends away from the lower surface of the panel. The bristles are resiliently flexible. A pole is elongate and has a first end and a second end. A rod is attached to and extends away from the first end of the pole. The top side of the bar is abutted against the bottom surface of the panel such that the aperture is aligned with the hole. The cap is extended into the aperture such that rod is extended through the aperture. A securing member is removably secured to the rod.

In these respects, the broom device according to the present invention substantially departs from the conventional concepts and designs of the prior art, and in so doing provides an apparatus primarily developed for the purpose of removably securing a handle to a broom an improved manner.

SUMMARY OF THE INVENTION

In view of the foregoing disadvantages inherent in the known types of broom devices now present in the prior art, the present invention provides a new broom device construction wherein the same can be utilized for removably securing a handle to a broom an improved manner.

The general purpose of the present invention, which will be described subsequently in greater detail, is to provide a new broom device apparatus and method which has many of the advantages of the broom devices mentioned heretofore and many novel features that result in a new broom device which is not anticipated, rendered obvious, suggested, or even implied by any of the prior art broom devices, either alone or in any combination thereof.

To attain this, the present invention generally comprises a bar having a top side, a bottom side and peripheral edge. The bar is elongate and has a first end and a second end. A hole extends through the top and bottom sides of the bar and is positioned generally between the first and second ends. A panel has an upper surface, a lower surface and a peripheral edge extending between the upper and lower surfaces. The panel has at least one aperture therein extending through the upper and lower surfaces. Each of a plurality of bristles is attached to and extends away from the lower surface of the panel. The bristles are resiliently flexible. A pole is elongate and has a first end and a second end. A rod is attached to and extends away from the first end of the pole. The top side of the bar is abutted against the bottom surface of the panel such that the aperture is aligned with the hole. The cap is extended into the aperture such that rod is extended through the aperture. A securing member is removably secured to the rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new broom device apparatus and method which has many of the advantages of the broom devices mentioned heretofore and many novel features that result in a new broom device which is not anticipated, rendered obvious, suggested, or even implied by any of the prior art broom devices, either alone or in any combination thereof.

It is another object of the present invention to provide a new broom device which may be easily and efficiently manufactured and marketed.

It is a further object of the present invention to provide a new broom device which is of a durable and reliable construction.

An even further object of the present invention is to provide a new broom device which is susceptible of a low cost of manufacture with regard to both materials and labor, and which accordingly is then susceptible of low prices of sale to the consuming public, thereby making such broom device economically available to the buying public.

Still yet another object of the present invention is to provide a new broom device which provides in the apparatuses and methods of the prior art some of the advantages thereof, while simultaneously overcoming some of the disadvantages normally associated therewith.

Still another object of the present invention is to provide a new broom device for removably securing a handle to a broom an improved manner.

Yet another object of the present invention is to provide a new broom device which includes a bar having a top side, a bottom side and peripheral edge. The bar is elongate and has a first end and a second end. A hole extends through the top and bottom sides of the bar and is positioned generally between the first and second ends. A panel has an upper surface, a lower surface and a peripheral edge extending between the upper and lower surfaces. The panel has at least one aperture therein extending through the upper and lower surfaces. Each of a plurality of bristles is attached to and extends away from the lower surface of the panel. The bristles are resiliently flexible. A pole is elongate and has a first end and a second end. A rod is attached to and extends away from the first end of the pole. The top side of the bar is abutted against the bottom surface of the panel such that the aperture is aligned with the hole. The cap is extended into the aperture such that rod is extended through the aperture. A securing member is removably secured to the rod.

Still yet another object of the present invention is to provide a new broom device that secures a handle better than conventional brooms which are coupled directly to the panel having the bristles thereon which often become loose after use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
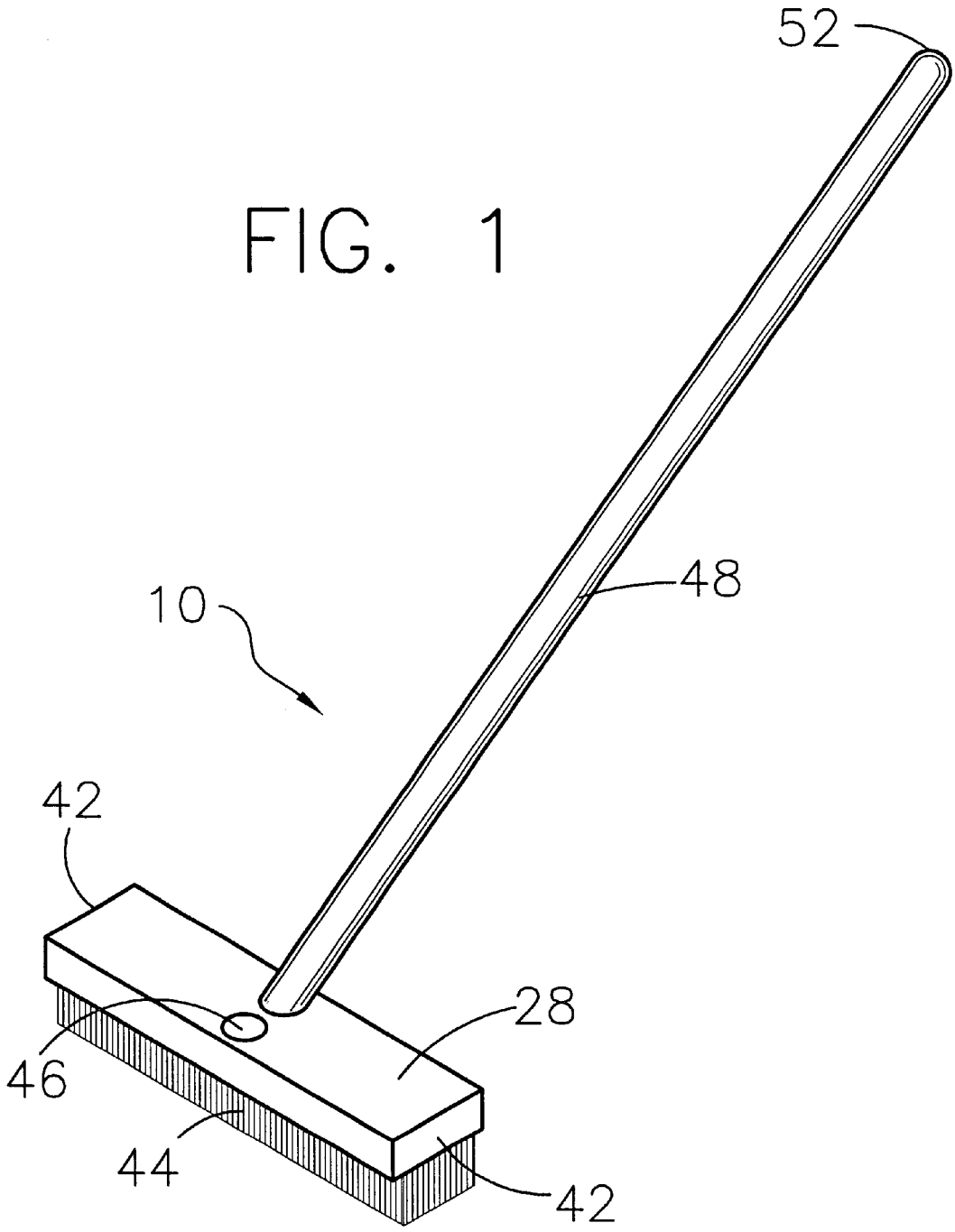
FIG. 1 is a schematic perspective view of a new broom device according to the present invention.
Figure 2:
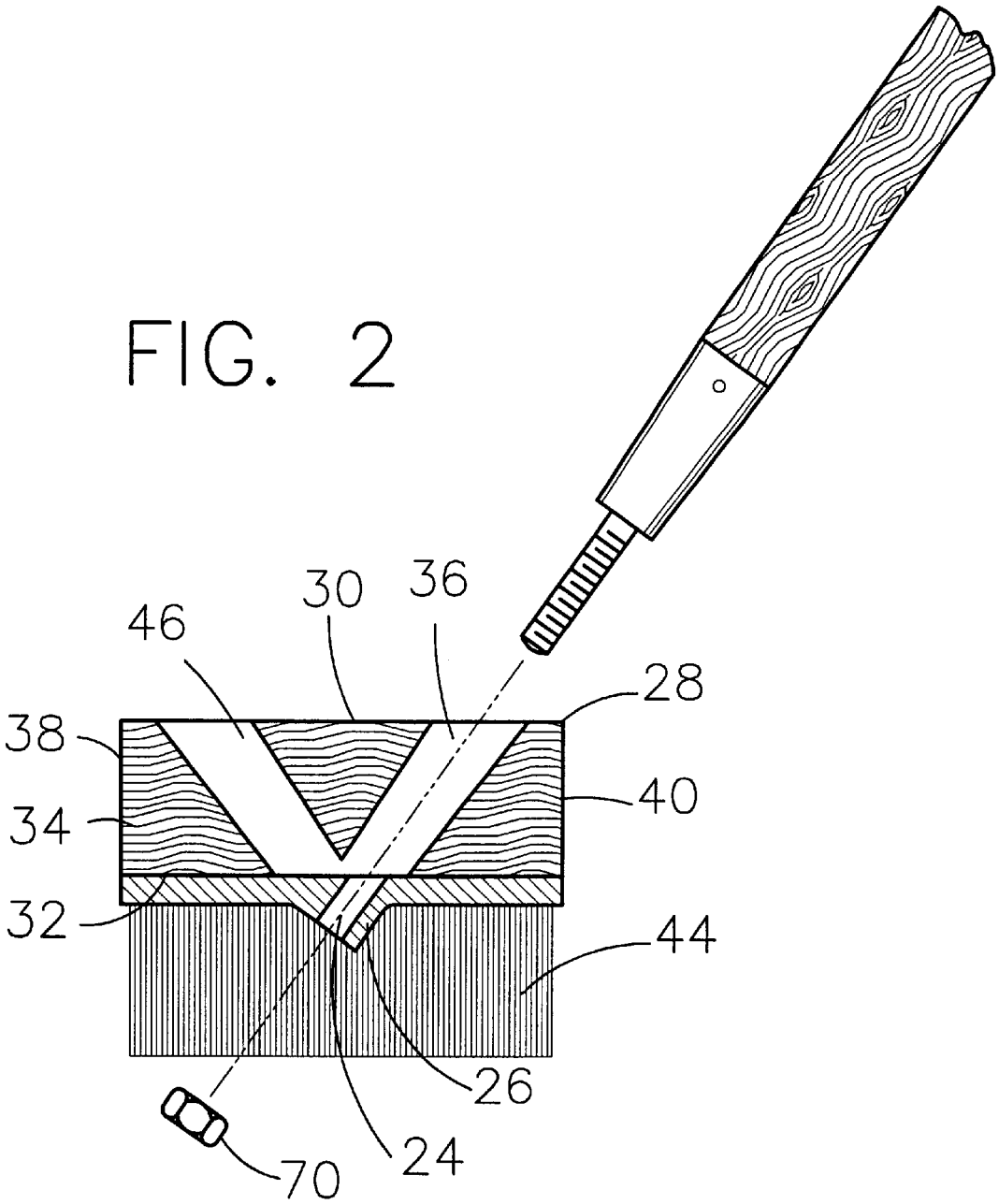
FIG. 2 is a schematic cross-sectional view of the present invention.
Figure 3:
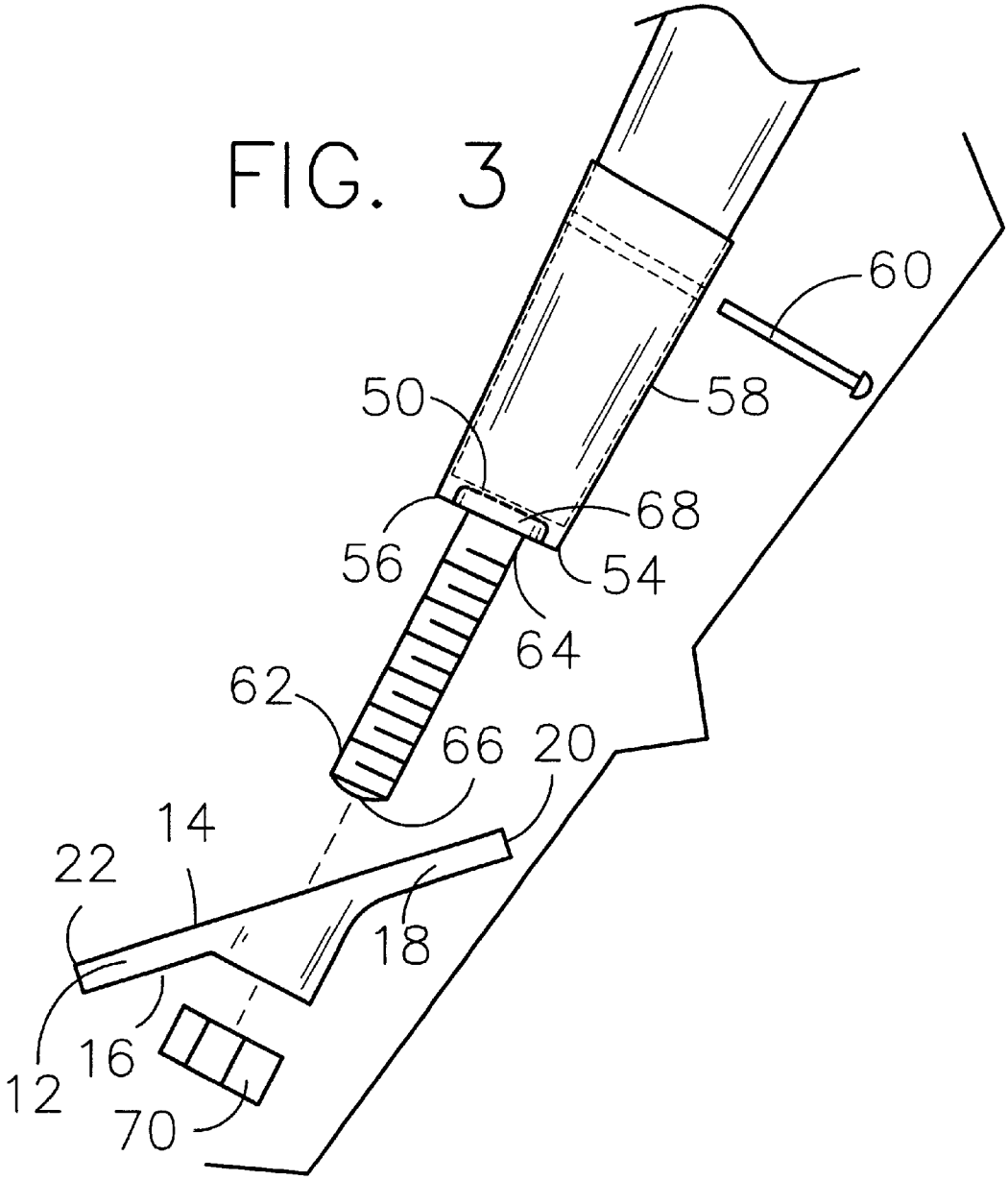
FIG. 3 is a schematic side view of the present invention.

With reference now to the drawings, and in particular to FIGS. 1 through 3 thereof, a new broom device embodying the principles and concepts of the present invention and generally designated by the reference numeral 10 will be described.

As best illustrated in FIGS. 1 through 3, the broom device 10 generally comprises a bar 12 having a top side 14, a bottom side 16 and peripheral edge 18. The bar 12 is rigid. The bar 12 is elongate and has a first end 20 and a second end 22. A hole 24 extends through the top 14 and bottom 16 sides of the bar 12 and is positioned generally between the first 20 and second 22 ends. The hole 24 is angled with respect to a plane of the top side 14 at an angle generally between 65 degrees and 80 degrees. The hole 24 has an edge having an annular lip 26 thereon extending away from the bottom side.

A panel 28 has an upper surface 30, a lower surface 32 and a peripheral edge 34 extending between the upper 30 and lower 32 surfaces. The panel 28 has at least one aperture 34 therein extending through the upper 30 and lower 32 surfaces. The aperture 36 is angled with respect to the upper surface 30 at an angle generally equal to an angle of the hole 24. The peripheral edge 34 includes a front edge 38, a back edge 40 and a pair of side edges 42. The aperture 36 is positioned generally between the side edges 42 and generally nearer the back edge 40 than the front edge 38. A plurality of bristles 44 is attached to and extends away from the lower surface 32 of the panel 28. The bristles 44 are resiliently flexible. The panel 28 has a second aperture 46 therein positioned between the side edges and nearer the front edge 38. The second aperture 46 is angled an angle generally equal to an angle of the other aperture 36 such that the two apertures extend toward each other.

A pole is 48 elongate and has a first end 50 and a second end 52. The pole 48 is rigid and defines a handle.

A cap member 54 is positioned over the first end 50 of the pole 48. The cap 54 has a bottom wall 56 and a perimeter wall 58 extending upwardly from the bottom wall 56. A fastener 60 extends through the perimeter wall 58 of the cap member 54 and into the pole 48. The cap member 54 is extendable into the aperture 36 in the panel 28.

A rod 62 is elongated and has a first end 64 and a second end 66. The first end 64 has a head 68 thereon positioned between the first end 50 of the pole 48 and the bottom wall 56. The rod 56 extends through the bottom wall 56 and is threaded. The rod 56 is extendable through the hole 24.

In use, the top side 32 of the bar 12 is abutted against the bottom surface 32 of the panel 28 such that the aperture 36 is aligned with the hole 24. The cap 54 is extended into the aperture 36 such that rod 62 is extended through the aperture 36. A securing member 70 is removably secured to the rod 62. The securing member 70 comprises a nut. The nut 70 is threadably coupled to the rod 62. The device 10 is used as a conventional broom where the handle 48 is secured to the panel 28 in an improved manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A broom and handle combination device comprising:

a bar having a top side a bottom side and peripheral edge, said bar being rigid, said bar being elongate and having a first end and a second end, a hole extending through said top and bottom sides of said bar and being positioned generally between said first and second ends;

a panel having an upper surface a lower surface and a peripheral edge extending between said upper and lower surfaces, said panel having at least one aperture therein extending through said upper and lower surfaces, a plurality of bristles being attached to and extending away from said lower surface of said panel, said bristles being resiliently flexible;

a pole being elongate and having a first end and a second end;

a rod being attached to and extending away from said first end of said pole;

wherein said top side of said bar is abutted against said bottom surface of said panel such that said aperture is aligned with said hole, wherein said cap is extended into said aperture such that rod is extended through said aperture;

a securing member being removably secured to said rod; and wherein said hole has an edge having an annular lip thereon extending away from said bottom side.

2. The broom and handle combination device as in claim 1, wherein said hole is angled with respect to a plane of said top side at an angle generally between 65 degrees and 80 degrees, said aperture being angled with respect to said upper surface at an angle generally equal to an angle of said hole.

3. The broom and handle combination device as in claim 1, wherein said peripheral edge of said panel includes a front edge, a back edge and a pair of side edges, said aperture being positioned generally between said side edges and generally nearer said back edge than said front edge.

4. The broom and handle combination device as in claim 1, further including a cap member being positioned over said first end of said pole, said cap having a bottom wall and a perimeter wall extending upwardly from said bottom wall, a fastener extending through said perimeter wall of said cap member and into said pole, said cap member being extendable into said aperture in said panel, said rod being elongated and having a first end and a second end, said first end having a head thereon and positioned between said first end of said pole and said bottom wall, said rod extending through said bottom wall.

5. The broom and handle combination device as in claim 1, wherein said rod is threaded, said securing member comprising a nut, said nut being threadably coupled to said rod.

6. A broom and handle combination device comprising:

a bar having a top side a bottom side and peripheral edge, said bar being rigid, said bar being elongate and having a first end and a second end, a hole extending through said top and bottom sides of said bar and being positioned generally between said first and second ends, said hole being angled with respect to a plane of said top side at an angle generally between 65 degrees and 80 degrees, said hole having an edge having an annular lip thereon extending away from said bottom side;

a panel having an upper surface a lower surface and a peripheral edge extending between said upper and lower surfaces, said panel having at least one aperture therein extending through said upper and lower surfaces, said aperture being angled with respect to said upper surface at an angle generally equal to an angle of said hole, said peripheral edge including a front edge, a back edge and a pair of side edges, said aperture being positioned generally between said side edges and generally nearer said back edge than said front edge, a plurality of bristles being attached to and extending away from said lower surface of said panel, said bristles being resiliently flexible;

a pole being elongate and having a first end and a second end;

a cap member being positioned over said first end of said pole, said cap having a bottom wall and a perimeter wall extending upwardly from said bottom wall, a fastener extending through said perimeter wall of said cap member and into said pole, said cap member being extendable into said aperture in said panel;

a rod being elongated and having a first end and a second end, said first end having a head thereon and positioned between said first end of said pole and said bottom wall, said rod extending through said bottom wall and being threaded, said rod being extendable through said hole;

wherein said top side of said bar is abutted against said bottom surface of said panel such that said aperture is aligned with said hole, wherein said cap is extended into said aperture such that rod is extended through said aperture;

a securing member being removably secured to said rod, said securing member comprising a nut, said nut being threadably coupled to said rod.

7. The broom and handle combination device as in claim 6, wherein said panel has a second aperture therein, said second aperture being positioned between said side edges and nearer said front edge, said second aperture being angled an angle generally equal to an angle of said hole.

8. A broom and handle combination device comprising:

a bar having a top side a bottom side and peripheral edge, said bar being rigid, said bar being elongate and having a first end and a second end, a hole extending through said top and bottom sides of said bar and being positioned generally between said first and second ends;

a panel having an upper surface a lower surface and a peripheral edge extending between said upper and lower surfaces, said panel having at least one aperture therein extending through said upper and lower surfaces, a plurality of bristles being attached to and extending away from said lower surface of said panel, said bristles being resiliently flexible;

a pole being elongate and having a first end and a second end;

a rod being attached to and extending away from said first end of said pole;

wherein said top side of said bar is abutted against said bottom surface of said panel such that said aperture is aligned with said hole, wherein said cap is extended into said aperture such that rod is extended through said aperture;

a securing member being removably secured to said rod; and wherein said rod is threaded, said securing member comprising a nut, said nut being threadably coupled to said rod.

9. The broom and handle combination device as in claim 8, wherein said hole is angled with respect to a plane of said top side at an angle generally between 65 degrees and 80 degrees, said aperture being angled with respect to said upper surface at an angle generally equal to an angle of said hole.

10. The broom and handle combination device as in claim 8, wherein said peripheral edge of said panel includes a front edge, a back edge and a pair of side edges, said aperture being positioned generally between said side edges and generally nearer said back edge than said front edge.

11. The broom and handle combination device as in claim 8, further including a cap member being positioned over said first end of said pole, said cap having a bottom wall and a perimeter wall extending upwardly from said bottom wall, a fastener extending through said perimeter wall of said cap member and into said pole, said cap member being extendable into said aperture in said panel, said rod being elongated and having a first end and a second end, said first end having a head thereon and positioned between said first end of said pole and said bottom wall, said rod extending through said bottom wall.

* * * * *